US010190580B2

(12) United States Patent
Graybill

(10) Patent No.: US 10,190,580 B2
(45) Date of Patent: Jan. 29, 2019

(54) SOLAR DRIVE CONTROL SYSTEM FOR OIL PUMP JACKS

(71) Applicant: Raptor Lift Solutions, LLC, Houston, TX (US)

(72) Inventor: Kavan Graybill, Leicester, NC (US)

(73) Assignee: Raptor Lift Solutions, LLC, Houston, TX (US)

( * ) Notice: Subject to any disclaimer, the term of this patent is extended or adjusted under 35 U.S.C. 154(b) by 0 days.

(21) Appl. No.: 16/043,428

(22) Filed: Jul. 24, 2018

(65) Prior Publication Data

US 2018/0328354 A1 Nov. 15, 2018

Related U.S. Application Data

(63) Continuation of application No. 15/852,736, filed on Dec. 22, 2017, now Pat. No. 10,072,651, which is a continuation of application No. 15/456,796, filed on Mar. 13, 2017, now Pat. No. 9,890,776, which is a continuation of application No. 14/208,299, filed on Mar. 13, 2014, now Pat. No. 9,617,990.

(60) Provisional application No. 61/852,540, filed on Mar. 18, 2013.

(51) Int. Cl.

| | |
|---|---|
| ***F04B 47/02*** | (2006.01) |
| ***F02B 17/00*** | (2006.01) |
| ***F04B 17/02*** | (2006.01) |
| ***F04B 17/00*** | (2006.01) |

(52) U.S. Cl.
CPC ..... *F04B 47/022* (2013.01); *F04B 17/006* (2013.01); *F04B 17/02* (2013.01)

(58) Field of Classification Search
CPC ..... F02B 47/022; F02B 2/006
USPC ..... 60/641.1
See application file for complete search history.

(56) References Cited

U.S. PATENT DOCUMENTS

| | | | | |
|---|---|---|---|---|
| 5,409,356 | A | 4/1995 | Massie | |
| 2005/0281680 | A1 | 12/2005 | Schulz | |
| 2007/0075545 | A1 | 4/2007 | Wilson et al. | |
| 2007/0286750 | A1* | 12/2007 | Beck | F04B 47/02 417/415 |
| 2008/0262857 | A1 | 10/2008 | Perera | |
| 2010/0054959 | A1 | 3/2010 | Rogers et al. | |
| 2010/0143158 | A1 | 6/2010 | Alston | |
| 2011/0097214 | A1 | 4/2011 | Wentworth et al. | |
| 2011/0103974 | A1 | 5/2011 | Lamascus et al. | |
| 2012/0177504 | A1 | 7/2012 | Beck et al. | |
| 2012/0223584 | A1 | 9/2012 | Ledenev | |
| 2013/0263613 | A1 | 10/2013 | Bittner et al. | |

OTHER PUBLICATIONS

Rising oil prices have fueled advances in underground drilling but ground-level technologies have been stagnant for decades . . . Until Now. by Lozanova May/Jun. 2011.

* cited by examiner

*Primary Examiner* — Mark Laurenzi
*Assistant Examiner* — Dapinder Singh
(74) *Attorney, Agent, or Firm* — Baker & Hostetler LLP

(57) ABSTRACT

A system for supplementing the electric power needed by a pump jack electric motor, thereby reducing the electric power purchased from the local utility or power supplier. The system comprises a solar photovoltaic system, or other forms of renewable energy, and regenerated power from the electric motor or drive. The system can be both "on-grid" and "off-grid." Battery banks and capacitor banks may be used to store energy.

10 Claims, 3 Drawing Sheets

SOLAR DRIVE CONTROL SYSTEM FOR OIL PUMP JACKS

PRIORITY INFORMATION

The present application is a continuation application of U.S. application Ser. No. 15/852,736 filed Dec. 22, 2017, that, in turn, is a continuation application of U.S. application Ser. No. 15/456,796 filed Mar. 13, 2017 that, in turn, is a continuation application of U.S. application Ser. No. 14/208,299 filed Mar. 13, 2014 that, in turn, claims the benefit of and priority to U.S. Provisional Application No. 61/852,540, filed Mar. 18, 2013. The specification, figures and complete disclosure of U.S. Provisional Application No. 61/852,540 and U.S. application Ser. No. 14/208,299, and U.S. application Ser. No. 15/456,796, and U.S. application Ser. No. 15/852,736 are incorporated herein by specific reference for all purposes.

FIELD OF THE INVENTION

This invention relates to a system for coordinating the use of solar energy and other forms of renewable energy with regenerated energy from oil pump jacks.

BACKGROUND OF THE INVENTION

A pump jack is a surface drive mechanism for a reciprocating piston pump in an oil well, and is used to mechanically lift oil or other liquids out of the well when there is insufficient subsurface pressure. Pump jacks are typically used onshore in relatively oil-rich areas. Modern pump jacks typically are powered by a electric motor, and the pump jack converts the motive force of the motor to a vertical reciprocating motion to drive the pump shaft (thereby causing a characteristic nodding motion). Electrical power usually is obtained from the electrical grid of the local electric utility or power supplier.

SUMMARY OF THE INVENTION

In various exemplary embodiments, the present invention comprises a system for supplementing the electric power needed by a pump jack electric motor, thereby reducing the electric power purchased from the local utility or power supplier. In one embodiment, the system comprises a solar photovoltaic system and regenerated power from the electric motor or drive. The system can be both "on-grid" and "off-grid."

In an "on-grid" embodiment, the system allows for a balanced connection between the utility power grid and a solar photovoltaic system through the DC buss of a regenerative variable frequency drive (VFD) or variable speed drive. In general, the power required to operate the pump jack motor or drive is provided by the solar photovoltaic system and by the energy from the regenerative action from the operation of the pump jack on the electric motor. Any additional power required to operate the pump jack motor may come from the utility power grid. Any excess power may be sold back to the local utility via a "net meter" agreement or similar arrangement.

The solar photovoltaic system may be connected directly to the common DC buss on the regenerative variable speed drive, which allows the regenerative drive to convert energy produced by the solar photovoltaic system (which is DC energy) to synchronized 3-phase waveforms. This is the utility-required format for energy passed from the system to the utility grid.

In several embodiments, the regenerative capabilities of the drive must meet or exceed all utility requirements for power filtering and harmonic issues that are required for direct connection of the drive to the utility with respect to the driver supplying power back to the utility. The regenerative drive must meet or exceed all utility requirements concerning direct interconnection guidelines for small generator interconnect agreements.

In an "off-grid" embodiment, the system captures and/or reuses the power generated from a solar photovoltaic array, an optional wind turbine or wind turbine array, as well as the regenerated power from the pump jack drive. Regenerative power from the pump jack drive may be stored in a 480 DC capacitor bank, and fed back into the DC buss of the variable frequency drive. The solar and wind energy may be stored in a 480 DC battery bank. Energy needed to run the pump jack motor is pulled from the capacitor bank, with additional energy as needed pulled from the battery bank. In another embodiment where the system is connected to the power grid as well, the power grid also may be a source of energy to make up any difference. The battery bank and capacitor bank are sized by the load needed to operate the respective pump jack drive or motor.

DETAILED DESCRIPTION OF EXEMPLARY EMBODIMENTS

In various exemplary embodiments, the present invention comprises a system for supplementing the electric power needed by a pump jack electric motor, thereby reducing the electric power purchased from the local utility or power supplier. In one embodiment, the system comprises a solar photovoltaic system and regenerated power from the electric motor or drive. The system can be both "on-grid" and "off-grid."

Figure 1:
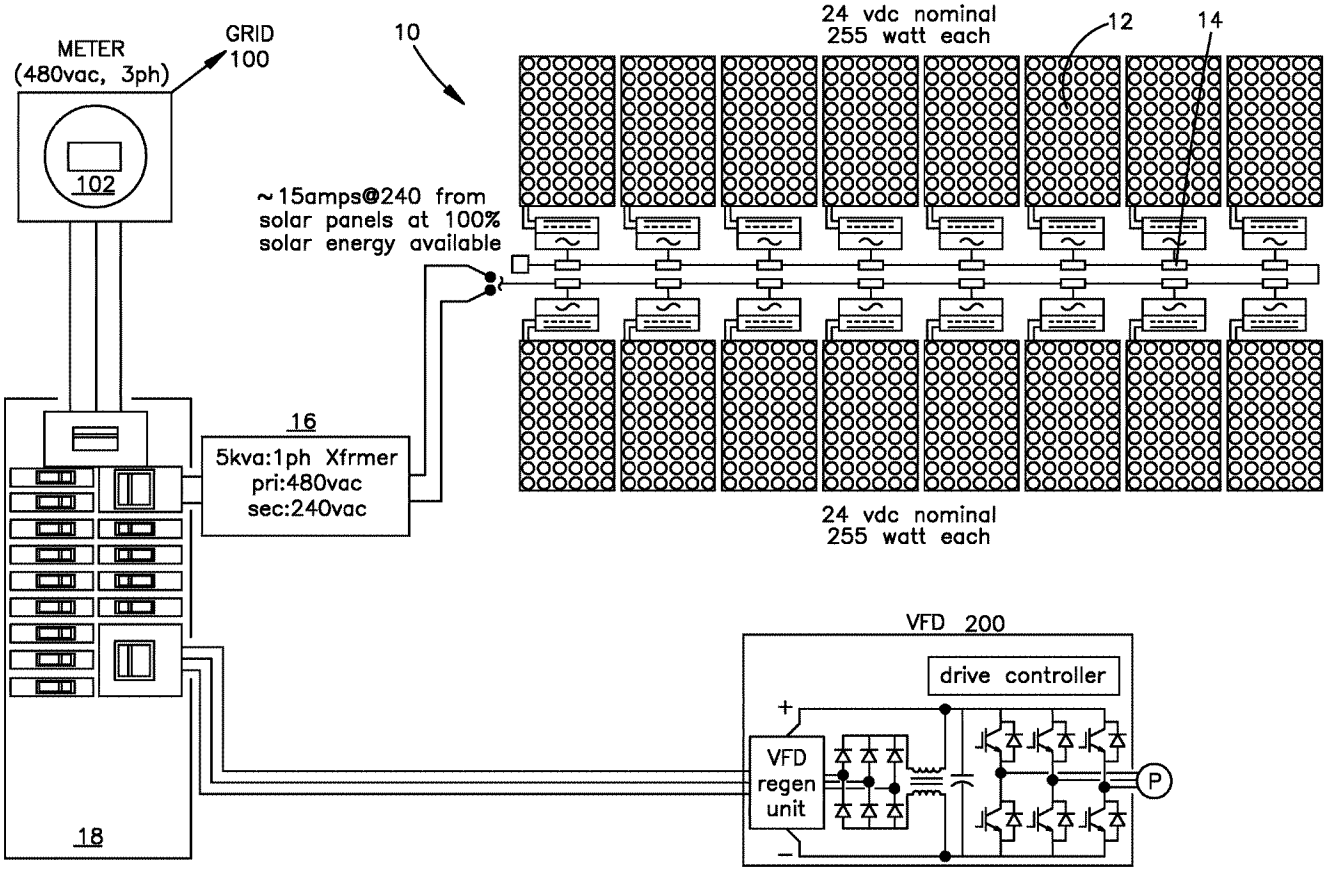
FIG. 1 shows a view of a system in accordance with an embodiment of the present invention.

In an "on-grid" embodiment, as seen in FIG. 1, the system allows for a balanced connection between the utility power grid 100 and a solar photovoltaic system 10 through the DC buss of a regenerative variable frequency drive (VFD), also referred to by several other terms, including, but not limited to, variable speed drive, variable speed controller, or similar terms 200. In general, the power required to operate the pump jack motor or drive is provided by the solar photovoltaic system 10 and by the energy from the regenerative action from the operation of the pump jack on the electric motor. Any additional power required to operate the pump jack motor may come from the utility power grid 100. Any excess power may be sold back to the local utility via a "net meter" agreement or similar arrangement.

As seen in FIG. 1, in one embodiment the solar photovoltaic system comprises an array of solar panels 12 (with kW output sized by load), connected through individual solar inverters 14 (which, in the embodiment shown, converts 24V DC to 240V AC) to a transformer 16, which in turn is connected to the power distribution box 18. In this embodiment, the transformer converts 240V AC to 480V AC single phase. The power distribution box is connected to the power grid 100 through a meter 102. The VFD with front-end regenerative unit controls the speed of the motor, and is grid tied to the invertor for the solar array system converting 480V AC single phase to 480V three phase. The regenerative unit may be integrated with the VFD, or may be a separate unit connected thereto.

Figure 2:
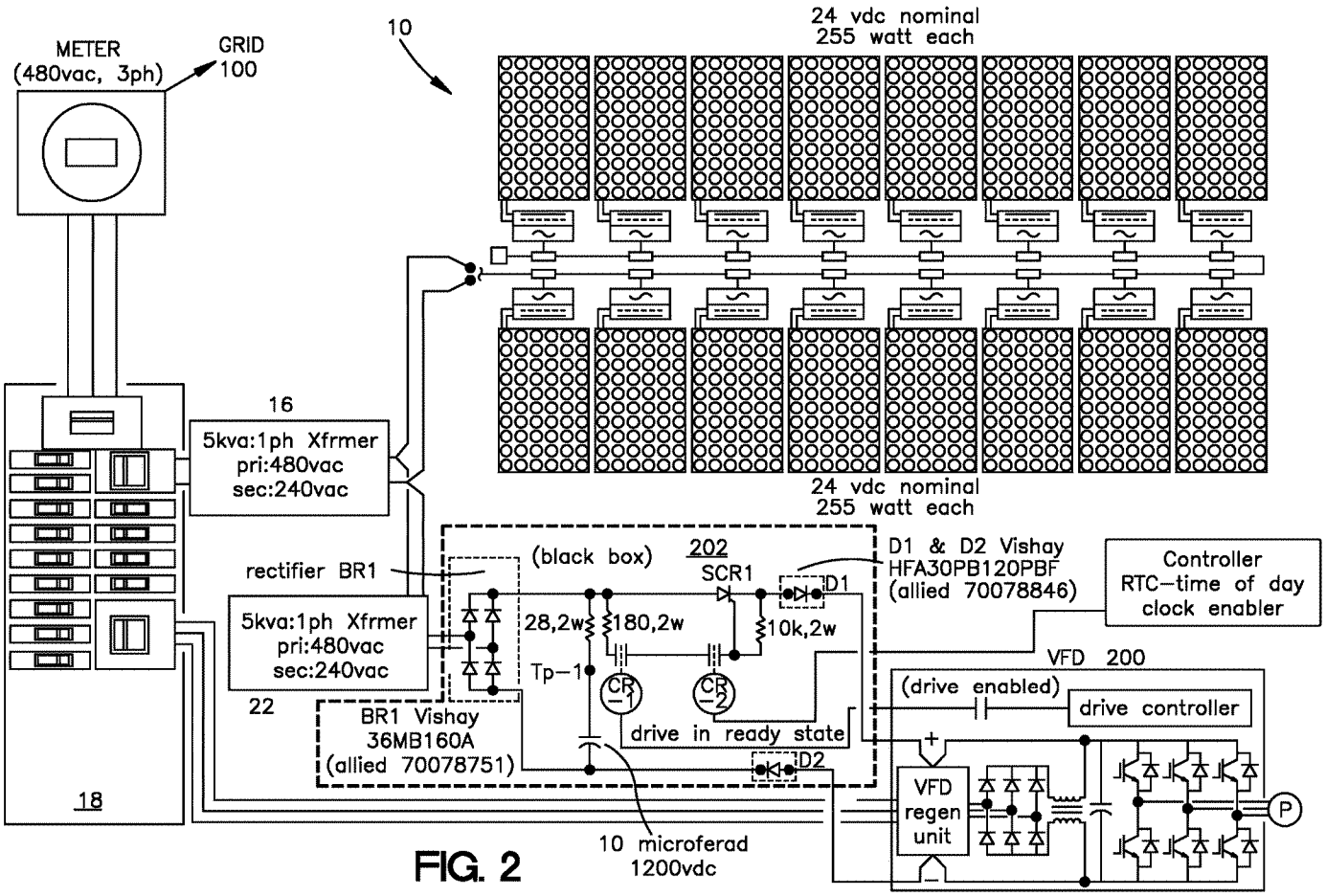
FIG. 2 shows a view of a system with direct connection between the solar array and the regenerative unit of the variable speed drive.

As seen in FIG. 2, the solar photovoltaic system 10 may be connected directly to the common DC buss on the regenerative VFD 200, which allows the regenerative drive to convert energy produced by the solar photovoltaic system (which is DC energy) to synchronized 3-phase waveforms. This is the utility-required format for energy passed from the system to the utility grid. In the embodiment shown, a second transformer 22 is added (in this embodiment, converting 240V AC to 480 V AC), and is connected to inverter 202, which inverts 480V AC single phase to 650V DC, thereby tying the energy from the solar panel array directly to the VFD 200.

In several embodiments, the regenerative capabilities of the drive must meet or exceed all utility requirements for power filtering and harmonic issues that are required for direct connection of the drive to the utility with respect to the driver supplying power back to the utility. The regenerative drive must meet or exceed all utility requirements concerning direct interconnection guidelines for small generator interconnect agreements. For both of the above examples, the parameters for the VFD may be adjusted to increase the amount of regenerated energy and optimize the power usage of the pump jack.

While the above discussion was in the context of solar power, other forms of renewable energy sources may be used, including, but not limited to, wind and hydro-electric. These may be used separately, or in combination.

Figure 3:
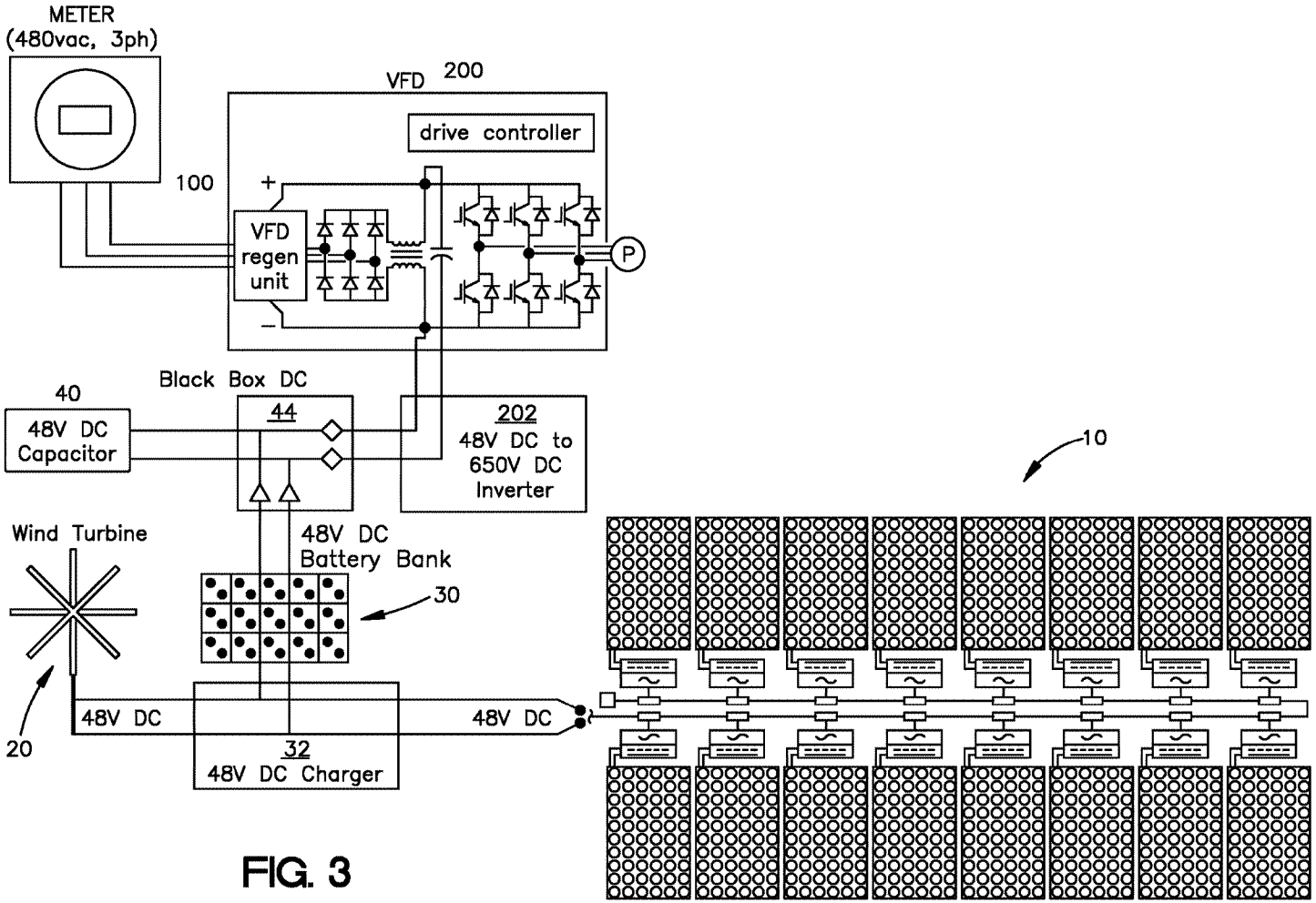
FIG. 3 shows a view of an "off-grid" system.

In an "off-grid" embodiment with combined renewable energy sources, as seen in FIG. 3, the system captures and/or reuses the power generated from a solar photovoltaic array 10, an optional wind turbine or wind turbine array 20, as well as the regenerated power from the pump jack drive. Regenerative power from the pump jack drive may be stored in a DC capacitor bank (in this example, 48V) 40, and fed back into the DC buss of the variable frequency drive 200. The solar and wind energy are directed through a DC battery charger 32 (with size determined by the amount of energy generated by the solar array and wind turbine; in this example, 48V DC), and may be stored in a DC battery bank (in this example, 48V DC) 30. In one embodiment, the batteries may be lithium ion or lead acid batteries, and sized based on expected loads.

The capacitor bank is the storage bank for regenerated power from the motor, and allows the regenerated power to be stored and reused. In one embodiment, the bank comprises nickel oxide hydroxide high amperage capacitors.

Energy needed to run the pump jack motor is pulled from the capacitor bank 40, with additional energy as needed pulled from the battery bank 30, through a DC interconnection box 44. The interconnection box allows for level flow of DC power back to the capacitor bank, but stopping any reverse flow to the battery bank. The interconnection box is connected to inverter 202, which inverts 480V AC single phase to 650V DC (as described above for the direct connection embodiment).

In another embodiment where the system is connected to the power grid as well, the power grid also may be a source of energy to make up any difference. The battery bank and capacitor bank are sized by the load needed to operate the respective pump jack drive or motor. The VFD 200 controls the speed of the motor, and acts as inverter for on-grid and off-grid configurations.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An apparatus, comprising:

a regenerative variable frequency drive configured to generate energy from vertical reciprocating motion of a pump jack during normal operation of the pump jack, the regenerative variable frequency drive comprising a DC buss; and a DC capacitor bank configured to be electrically connected to the DC buss of the regenerative variable frequency drive, wherein when the DC capacitor bank is electrically connected to the DC buss of the regenerative variable frequency drive, at least a portion of energy required to operate the pump jack to produce petroleum hydrocarbons is obtained from the generated energy from the vertical reciprocating motion of the pump jack, further wherein said generated energy is stored in the DC capacitor bank, and removed from the DC capacitor bank to the DC buss of the regenerative variable frequency drive.

2. The apparatus as recited in claim 1, wherein the capacitor bank is configured to output the stored energy as direct current, and the regenerative variable frequency drive is configured to convert the direct current output from the capacitor bank to alternating current.

3. The apparatus as recited in claim 2, wherein the capacitor bank is configured to be electrically connected to the DC buss through a DC interconnection box.

4. The apparatus as recited in claim 1, wherein the capacitor bank is coupled to the DC buss.

5. The apparatus as recited in claim 4, wherein the capacitor bank outputs the stored energy as direct current, and the regenerative variable frequency drive converts the direct current output from the capacitor bank to alternating current.

6. The apparatus as recited in claim 5, wherein the capacitor bank is electrically connected to the DC buss through a DC interconnection box.

7. The apparatus as recited in claim 1, wherein the regenerative variable frequency drive is configured to couple to an electrical power grid, such that at least a portion of the energy required to operate the pump jack to produce petroleum hydrocarbons is provided by the electrical power grid.

8. A method comprising the steps of:

electrically connecting a DC capacitor bank to a DC buss of a regenerative variable frequency drive that is configured to provide energy to a pump jack to operate the pump jack, and is further configured to generate energy from vertical reciprocating motion of the pump jack during normal operation of the pump jack, wherein the step of electrically connecting causes the DC capacitor bank to receive and store energy from the reciprocating motion of the pump jack during normal operation of the pump jack, and output the stored energy to the DC buss of the regenerative variable frequency drive, such that at least a portion of the energy provided to the pump jack to operate the pump jack is provided by the DC capacitor bank.

9. The method as recited in claim 8, wherein the step of electrically connecting causes the DC capacitor bank to output direct current to the DC buss, and the regenerative variable frequency drive is configured to convert the direct current to alternating current.

10. The method as recited in claim 8, wherein the step of electrically connecting comprises electrically connecting the DC capacitor bank to the DC buss through a DC interconnection box.

* * * * *